US009422632B2

(12) United States Patent
Prado

(10) Patent No.: US 9,422,632 B2
(45) Date of Patent: Aug. 23, 2016

(54) DEVICE FOR MONITORING CURRENT DISTRIBUTION IN INTERCONNECTED ELECTROLYTIC CELLS

(71) Applicant: INDUSTRIE DE NORA S.P.A., Milan (IT)

(72) Inventor: Felix Prado, Monzon (ES)

(73) Assignee: INDUSTRIE DE NORA S.P.A., Milan (IT)

( * ) Notice: Subject to any disclaimer, the term of this patent is extended or adjusted under 35 U.S.C. 154(b) by 0 days.

(21) Appl. No.: 14/768,697

(22) PCT Filed: Feb. 20, 2014

(86) PCT No.: PCT/EP2014/053322
§ 371 (c)(1),
(2) Date: Aug. 18, 2015

(87) PCT Pub. No.: WO2014/128211
PCT Pub. Date: Aug. 28, 2014

(65) Prior Publication Data

US 2016/0002800 A1 Jan. 7, 2016

(30) Foreign Application Priority Data

Feb. 20, 2013 (IT) ..... MI2013A0235

(51) Int. Cl.

| | |
|---|---|
| ***C25C 7/02*** | (2006.01) |
| ***C25C 7/00*** | (2006.01) |
| ***C25C 7/06*** | (2006.01) |
| ***C25C 1/12*** | (2006.01) |
| ***C25C 3/16*** | (2006.01) |

(52) U.S. Cl.
CPC . *C25C 7/06* (2013.01); *C25C 1/12* (2013.01); *C25C 3/16* (2013.01); *C25C 7/00* (2013.01); *C25C 7/02* (2013.01)

(58) Field of Classification Search
CPC ..... C25C 7/06; C25C 7/00; C25C 7/02; C25C 3/16; C25C 1/12
See application file for complete search history.

(56) References Cited

U.S. PATENT DOCUMENTS

| | | | |
|---|---|---|---|
| 9,255,338 B2 * | 2/2016 | Prado | C25C 7/00 |
| 2003/0066759 A1 | 4/2003 | Hardee et al. | |
| 2012/0205254 A1 | 8/2012 | Navarro et al. | |

FOREIGN PATENT DOCUMENTS

| | | |
|---|---|---|
| WO | 2009016190 A2 | 2/2009 |
| WO | 2011123896 A1 | 10/2011 |

OTHER PUBLICATIONS

International Search Report issued in PCT Application No. PCT/EP2014/053322.

*Primary Examiner* — Nicholas A Smith
(74) *Attorney, Agent, or Firm* — Lucas & Mercanti, LLP

(57) ABSTRACT

The present invention relates to a device for the continuous monitoring of current distribution in the cathodes and anodes of an electrolyzer comprised of at least two adjacent electrolytic cells, each containing a multiplicity of said cathodes and anodes. The device according to the invention is composed essentially of at least one current-collecting bus-bar having housings suitable for supporting the electrodes and a base of insulating material whereon the bus-bar abuts. The base has integrated probes for measuring voltage. The invention also relates to a permanent monitoring system allowing to evaluate in continuous current distribution on each electrode in cells used in particular in metal electrowinning or electrorefining. The invention also relates to a method for retrofitting of an electrolyzer comprising the replacement of an existing insulating base with a new base element having integrated probes for measuring voltage.

17 Claims, 4 Drawing Sheets

DEVICE FOR MONITORING CURRENT DISTRIBUTION IN INTERCONNECTED ELECTROLYTIC CELLS

CROSS-REFERENCE TO RELATED APPLICATIONS

This application is a U.S. national stage of PCT/EP2014/053322 filed on Feb. 20, 2014 which claims the benefit of priority from Italian Patent Application No. MI 2013 A 000235 filed Feb. 20, 2013, the contents of each of which are incorporated herein by reference.

FIELD OF THE INVENTION

The invention relates to a system for monitoring current distribution in cells for electrometallurgical applications.

BACKGROUND OF THE INVENTION

The current supplied to cells of electrochemical plants, particularly to cells of metal electrowinning or electrorefining plants, may be distributed in a very diverse manner among the electrodes installed in said cells with negative consequences on production. Such phenomenon may occur for several reasons. For example, in the particular case of metal electrowinning or electrorefining plants, the electrodes of negative polarity (cathodes), are frequently removed from their seats to allow harvesting the product deposited thereon, to be later put back to their original locations for a subsequent production cycle. Such frequent handling, being generally carried out on a very large number of cathodes, often leads to an imperfect repositioning onto the respective current-collecting bus-bars giving rise to less-than-ideal electrical contacts, also due to possible fouling of the seats. Product deposition may additionally take place in an irregular fashion on the electrode surface, with formation of product mass gradients altering the surface profile of the cathode. Whenever this occurs, a state of electrical imbalance takes place caused by the anode-to-cathode gap being no longer constant along the whole surface: the electrical resistance, which is a function of the distance between each pair of anodes and cathodes, becomes variable, worsening the problem of irregular power distribution.

The current may therefore be apportioned in different extents to each electrode both due to bad electrical contacts between the electrode themselves and the current-collecting bus-bars and because of alterations of the surface profile of the cathodes. Moreover, even the simple wear of anodes may affect current distribution.

These inhomogeneities in the distribution of current can lead to anode-to-cathode short-circuits. In this case, the current tends to concentrate in the shorting areas with severe damage of the facing anodes. In addition, the short-circuit brings about a concentration of current on the affected cathode, diminishing current to the remaining cathodes and seriously hampering the production, which cannot be resumed until the shorted cathode is disconnected.

An uneven current distribution, besides generating a loss of quality and production capacity as mentioned, would also put at risk the integrity and lifetime of state-of-the-art anodes obtained starting from titanium meshes.

In industrial plants, given the high number of cells and electrodes present, the task of detecting irregularities in the distribution of current is very complex. Such measurement in fact involves thousands of manual measurements, carried out by operators via infrared or magnetic detectors. In the specific case of metal electrowinning or electrorefining installations, these detections are made by the operator in a high temperature environment and in the presence of acid mists, mainly consisting of sulphuric acid.

Moreover, conventional manual devices used by operators, such as gaussmeters or instruments with infrared sensors, allow to track down only large imbalances of current distribution, as they actually detect indirect imbalances generated by magnetic field or temperature variations, which in their turn are a function of local current intensity.

There are known systems for the wireless monitoring of cells which, in spite of being permanent and working in continuous, only detect changes in voltage and temperature for each cell and not for every single electrode. This information, as discussed above, is scarcely accurate and globally insufficient. In addition, there are now developmental projects aiming at the continuous detection of current supplied to individual cathodes by fixed current sensors relying on Hall effect: these sensors are active components that require a big size external power supply, such a large set of batteries.

Systems based on magnetic sensors are also known, nevertheless they do not offer a sufficient accuracy of measurement.

In conclusion, these manual or semi-manual systems have the disadvantage of not being suitable for continuous operation allowing only occasional checks; moreover, they have the disadvantage of being able to reveal only current variations of big magnitude in addition to being very expensive.

For these reasons, the industry is in need of a technically and economically viable system for permanently and continuously monitoring current distribution in all electrodes installed in cells of an electrowinning or electrorefining plant.

SUMMARY OF THE INVENTION

The present invention allows monitoring in continuous the current distribution of thousands of electrodes in electrochemical plants, for example in metal electrowinning or electrorefining plants, without using externally powered components and without requiring the presence of operators for carrying out manual measurements in unhealthy environments, by reporting the malfunctioning of one or more specific electrodes through an alerting system.

The absence of active electronic components such as infrared or magnetic sensors allows for a much cheaper and virtually maintenance-free system.

Various aspects of the invention are set out in the accompanying claims.

Under one aspect, the invention relates to a device for continuously monitoring current distribution in cathodes and anodes of an electrolyser comprised of at least two adjacent electrolysis cells, each containing a multiplicity of cathodes and anodes, the device comprising at least one inter-cell current collecting bus-bar consisting of an elongated main body of homogeneous electrical conductivity, the body comprising housings suitable for supporting cathodes and/or anodes and establishing an electrical contact therewith, the housings being evenly spaced apart, the inter-cell current collecting bus-bar abutting on at least one base element made of insulating material equipped with integrated probes for detecting an electrical voltage and for establishing electrical contacts in correspondence of the housings of the inter-cell current collecting bus-bar.

The term housings is used herein to indicate suitable seats for accommodating and supporting anodes and cathodes, as well as favouring optimum electrical contacts between the electrodes and the bus-bars.

By selecting suitable materials for current-collecting bus-bars characterised by constant conductivity in all directions, well defined geometries of electrode housings provided on the bus-bars and suitable electrical contacts between bus-bars and electrodes, the electric current apportionment to the electrodes can be put in direct correspondence with potential difference values that can be measured on the current-collecting bus-bars.

Under another aspect, the invention relates to a device for continuously monitoring current distribution in cathodes and anodes of an electrolyser comprised of at least two adjacent electrolysis cells, each containing a multiplicity of cathodes and anodes, the device comprising an auxiliary cathode bus-bar, an auxiliary anode bus-bar and at least one inter-cell current collecting bus-bar arranged therebetween, the auxiliary bus-bars and the inter-cell bus-bar consisting of elongated bodies of homogeneous electrical conductivity, the inter-cell current collecting bus-bar consisting of an elongated main body of homogeneous electrical conductivity comprising housings for supporting the cathodes and/or anodes and establishing an electrical contact therewith, the auxiliary and the inter-cell bus-bars abutting on at least one base element made of insulating material, the base element containing integrated probes for detecting an electrical voltage and for establishing electrical contacts in correspondence of the housings of the inter-cell current collecting bus-bar and for detecting an electrical voltage and establishing electrical contacts evenly spaced on either of the auxiliary bus-bars.

The auxiliary bus-bars have the function of absorbing the current which would be interrupted following an electrode malfunctioning. Advantageously, this feature allows not to stop the plant in case of malfunctioning of an electrode and to obtain, through the measurement of the electrical voltage on auxiliary bus-bars, a more accurate quantitative assessment of the malfunctioning.

In one embodiment, the insulating material of the base element is fibre-reinforced plastic (FRP).

The base element can consist of a single piece or be made of a multiplicity of separate parts, one per each current-collecting bus-bar, including auxiliary bus-bars.

The current-collecting bus-bars can have different shapes so that the housings can be placed at equal distances along the length of the bar; in another embodiment, a wider bus-bar can be provided with housings alternately positioned on opposite sides along its length.

In one embodiment, the probes for detecting an electrical voltage and establishing electrical contacts are cables or wires.

To ensure more efficient contacts, in correspondence of electrical contact areas, the probes can be equipped with retractable tips so as to compensate any deformation of the current-collecting bus-bar or of the insulating base element.

In another embodiment, the probes suitable for detecting an electrical voltage and establishing electrical contacts are equipped with retractable tips in correspondence of said electrical contacts.

Even though detection probes are integrated in the insulating base element, which already provides some protection per se, the use of additional insulating protections is preferred in view of the corrosive acid mist environment and of the proximity of the acidic solution to the contact points.

In one embodiment, the base element comprises springs lined with plastic fabric or seals made of rubber material in correspondence of retractable tips for their protection against the aggressive environment.

Under another aspect, the invention relates to an electrolyser comprising a multiplicity of cells for metal electrodeposition mutually connected in electrical series through a device as described above.

In one embodiment, the invention relates to an electrolyser wherein the multiplicity of cells is connected in electrical series at one end with a terminal cell whose anodes are connected to the positive pole of a direct power supply through a current collecting bus-bar equipped with housings for anodic electrical contacts, and the other end with a terminal cell whose cathodes are connected to the negative pole of said direct power supply through a current collecting bus-bar equipped with housings for cathodic electrical contacts and the current collecting bus-bars abut on a base element made of insulating material containing integrated probes for detecting an electrical voltage and establishing electrical contacts.

Under another aspect, the invention relates to a system for continuously monitoring current distribution in cathodes and anodes of an electrolyser comprised of cells for metal electrodeposition, each equipped with a multiplicity of said cathodes and anodes comprising a device as described above; analogue or digital computational means for obtaining current intensity values in each individual cathode and each anode starting from the electrical potential values detected by said probes; an alert device, a processor suitable for comparing the current intensity measurement provided by said computational means to a set of predefined critical values for each cathode and each anode; means for actuating said alert device whenever said current intensity results not compliant to said corresponding predefined critical value for any cathode or anode.

In a further aspect, the invention relates to a method for retrofitting an electrolyser consisting of at least two adjacent electrolysis cells and equipped with at least one inter-cell current collecting bus-bar, said inter-cell current collecting bus-bar consisting of an elongated main body of homogeneous electrical conductivity equipped with evenly spaced apart housings for supporting cathodes and/or anodes and establishing an electrical contact therewith, said inter-cell current collecting bus-bar abutting on at least one original base element made of insulating material comprising the steps of:

lifting said at least one inter-cell current collecting bus-bar from said original base element;

substituting said original base element with at least one replacement base element made of insulating material, said replacement base element containing integrated probes for detecting an electrical voltage and for establishing electrical contacts in correspondence of said housings of said at least one current collecting bus-bar; and putting said inter-cell current collecting bus-bar in abutment with said replacement base element.

In one embodiment, the invention relates to a method wherein the electrolyser consisting of at least two adjacent electrolysis cells is equipped with one inter-cell current collecting bus-bar, one auxiliary cathode bus-bar and one auxiliary anode bus-bar.

In a further embodiment, the invention relates to the method wherein the step of putting said inter-cell current collecting bus-bar in abutment with said replacement base element is carried out by aid of guides.

Some implementations exemplifying the invention will now be described with reference to the attached drawings, which have the sole purpose of illustrating the reciprocal arrangement of the different elements relatively to said particular implementations of the invention; in particular, drawings are not necessarily drawn to scale.

DETAILED DESCRIPTION OF THE DRAWINGS

Figure 1:
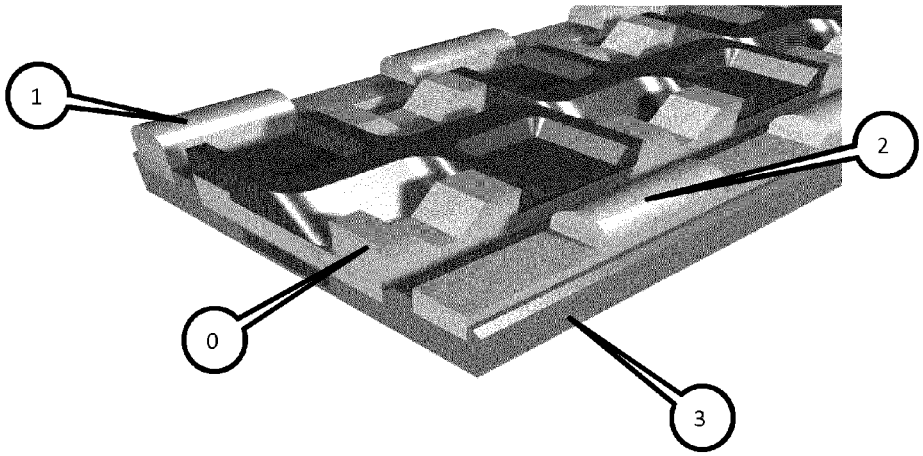
FIGS. 1, 2, 3 and 4 show a three-dimensional view of a possible embodiment of the invention comprising an inter-cell current collecting bus-bar, auxiliary anodic and cathodic bus-bars, a base element containing integrated probes for detecting an electrical voltage and for establishing electrical contacts.

FIG. 1 shows a three-dimensional top-view of a device comprising a conductive inter-cell current collecting bus-bar 0, an anodic auxiliary bus-bar 1, a cathodic auxiliary bus-bar 2, a base element 3.

Figure 2:
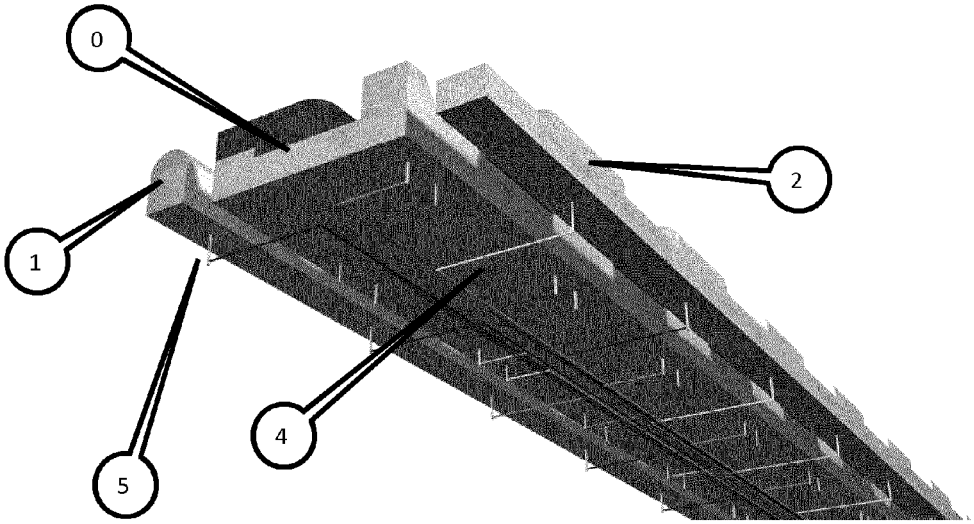

FIG. 2 shows a three-dimensional bottom-view of a conductive inter-cell current collecting bus-bar 0, an anodic auxiliary bus-bar 1, a cathodic auxiliary bus-bar 2, probes for the detection of potential 4 and retractable tips 5.

Figure 3:
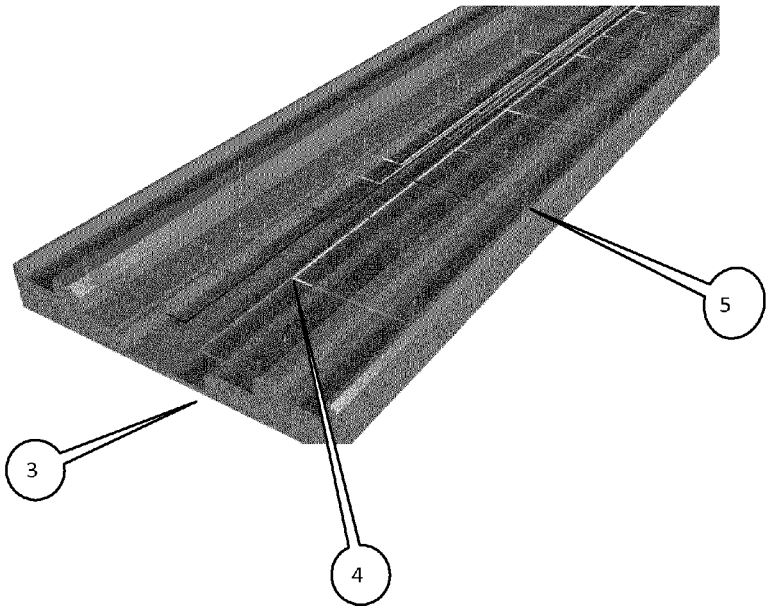
Figure 4:
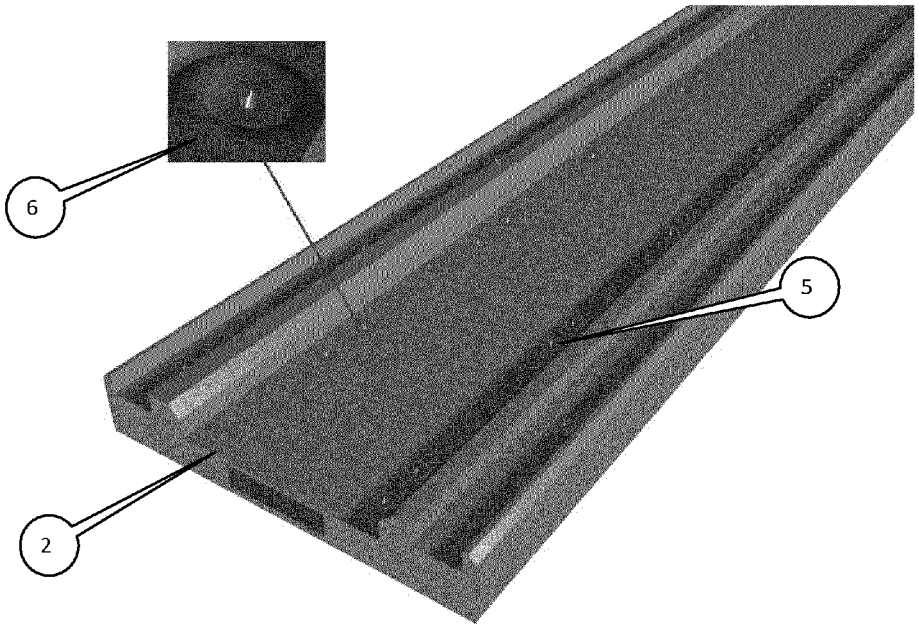

FIG. 3 shows a three-dimensional top-view of the arrangement of probes for the detection of potential 4 and retractable tips 5 as integrated into base element 3. FIG. 4 shows a top-view of a base element 2, retractable tips 5, a detail of a sealing rubber ring 6.

Figure 5:
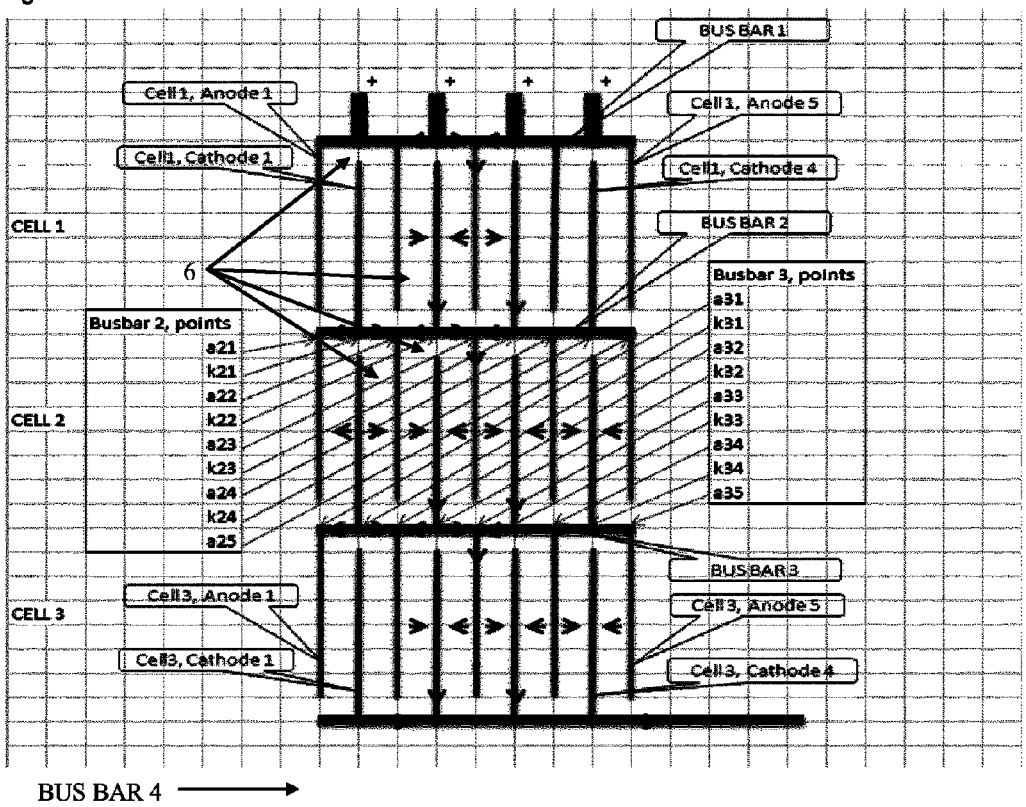
FIG. 5 shows a scheme of a plant consisting of three electrolytic cells connected in series, each cell comprising 5 anodes and 4 cathodes.

In FIG. 5 there is shown a scheme of the electrolyser system comprised of 3 electrolytic cells (Cell 1, Cell 2 and Cell 3) connected in electrical series, each comprising 5 anodes (Anode 1 and Anode 5 identifying the two external anodes), 4 cathodes (Cathode 1 and Cathode 4 identifying the two external cathodes), an anodic current collecting bus-bar (BUS BAR 1), a cathodic current collecting bus-bar (BUS BAR 4), two inter-cell current collecting bus-bars (BUS BAR 2 and BUS BAR 3), arrows indicating the direction of current flow 6, points for measuring the potential ($a_{21\text{-}25}$, $k_{21\text{-}24}$, $a_{31\text{-}35}$, $k_{31\text{-}34}$).

Figure 6:
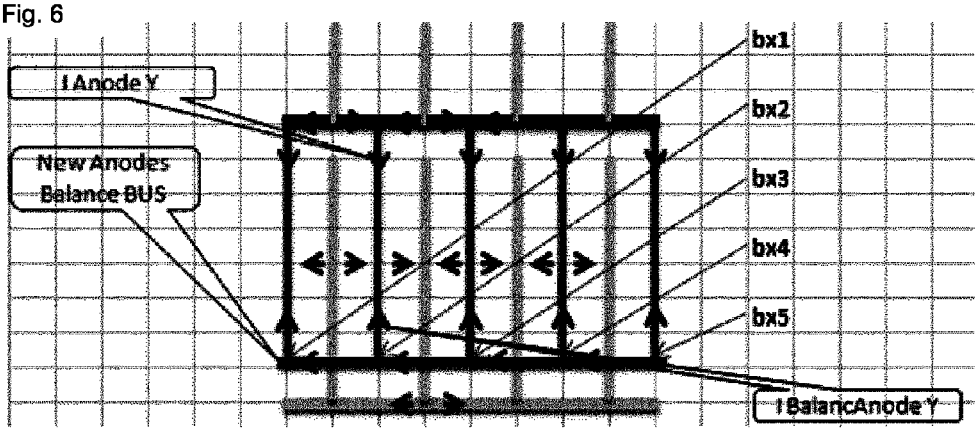
FIG. 6 shows a scheme of cell comprising an auxiliary bus-bar.

FIG. 6 shows a scheme of cell comprising an auxiliary bus-bar (New Anodes Balance BUS), arrows indicating the direction of the main current (I Anode Y), arrows indicating the compensation current (I BalanceAnode Y).

Figure 7:
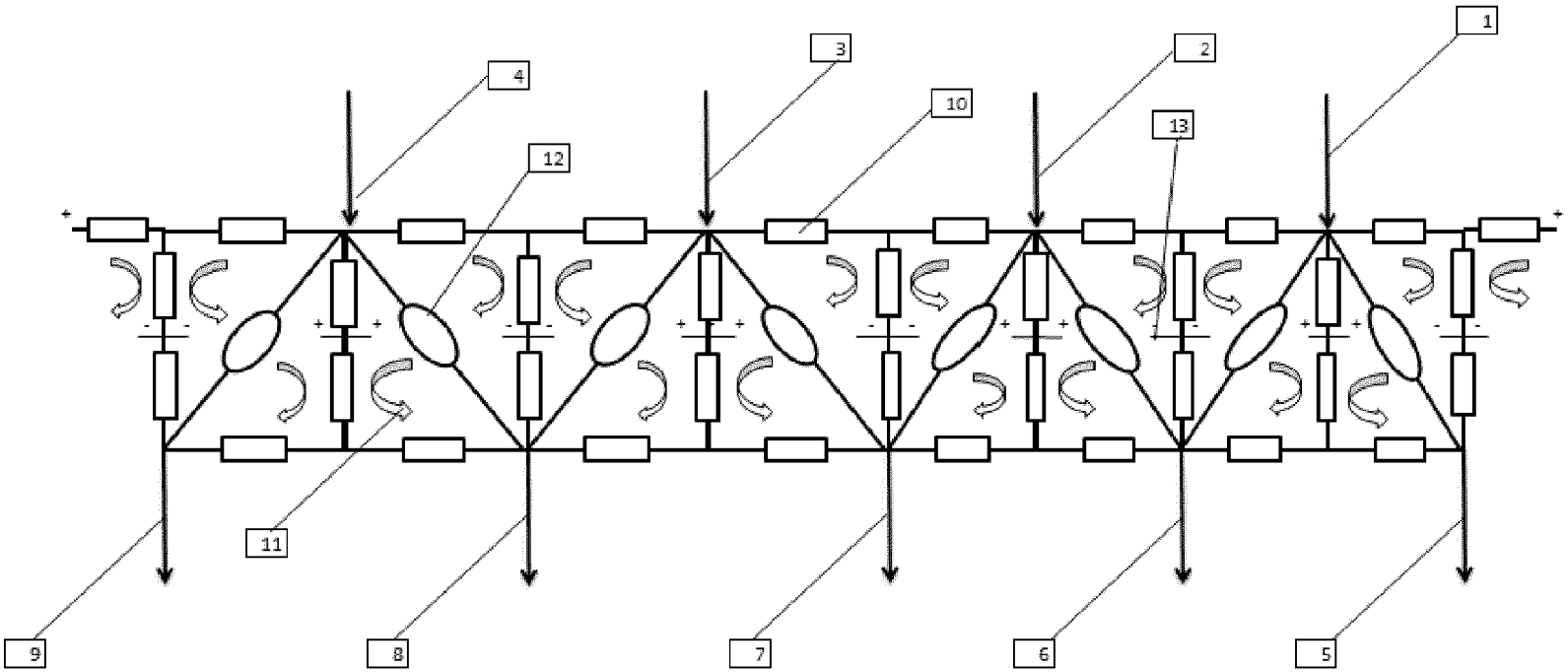
FIG. 7 shows a scheme of circuit representing a two-dimensional model of system comprising 5 anodes and 4 cathodes.

In FIG. 7 is shown a scheme of circuit representing a model that reproduces a two-dimensional current path for a cell having 4 cathodes and 5 anodes. Labels 1, 2, 3 and 4 represent currents to cathodes 1, 2, 3 and 4, respectively (not shown). Labels 5, 6, 7, 8, and 9 represent currents to anodes 1, 2, 3, 4 and 5 respectively (not shown). Label 10 indicates resistances representative of the electrical properties of the current collecting bus-bar. Label 11 indicates current flows inside the bar. Label 12 represents the voltage difference at contact points between two abutment points of two consecutive electrodes on the bar. Label 13 indicates points where measurements are taken.

Some of the most significant results obtained by the inventors are illustrated in the following example, which is not intended to limit the scope of the invention.

EXAMPLE

A copper electrowinning plant was assembled according to the scheme of FIG. 5. Three electrolytic cells, each comprising 5 anodes made of a titanium mesh coated with a catalytic layer based on iridium oxide and 4 copper cathodes, were connected in electrical series by means of two copper inter-cell current-collecting bus-bars with trapezoidal housings for the anodes and the cathodes (see FIG. 1). The two bus-bars were then housed on a base element of fibre-reinforced plastic containing 36 probes having retractable tips in correspondence of the 36 electrical contacts to be established (two per electrode). The probes were in their turn connected to a data logger equipped with microprocessor and database, programmed to trigger an alarm connected thereto in case a discrepancy of 10% compared to the set values was detected.

The method used to calculate the current apportionment in this specific case is based on the model expressed by the following formulas, with current I relevant to each anode and each cathode of cell 2 given by:

$$I(\text{anode } 1)=I'(k_{21},a_{21})$$

$$I(\text{anode } 2)=I''(k_{21},a_{22})+I'(k_{22},a_{22})$$

$$I(\text{anode } 3)=I''(k_{22},a_{23})+I'(k_{23},a_{23})$$

$$I(\text{anode } 4)=I''(k_{23},a_{24})+I'(k_{24},a_{24})$$

$$I(\text{anode } 5)=I''(k_{24},a_{25})$$

$$I(\text{cathode } 1)=I'(k_{31},a_{31})+I''(k_{31},a_{32})$$

$$I(\text{cathode } 2)=I'(k_{32},a_{32})+I''(k_{32},a_{33})$$

$$I(\text{cathode } 3)=I'(k_{33},a_{33})+I''(k_{33},a_{34})$$

$$I(\text{cathode } 4)=I'(k_{34},a_{34})+I''(k_{34},a_{35})$$

wherein I' and I'' identify currents flowing through fractions of current-collecting bus-bar comprised between each pair of electrical contacts across each cathode and each anode and $k_{21}$, $a_{21}$ identify the current flowing through the respective inter-cell current-collecting bus-bar in the segment between cathode 1 and anode 2 (the remaining pairs having an analogous meaning) with the former of each subscript of k and a indicating the cell number and the latter the cathode number or anode number respectively.

For a generic cell X, the following relationships therefore apply:

$$I(\text{anode } Y)=I''[k_{X(Y-1)},a_{XY}]+I'(k_{XY},a_{XY})$$

$$I(\text{cathode } Y)=I'[k(k_{(X+1)Y},a_{(X+1)Y}]+I''[k_{(X+1)Y},a_{(Y+1)(Y-1)}]$$

In view of the homogeneity of the material and configuration of current-collecting bus-bars, the value of the resistance R between any two consecutive electrical contacts of a bus-bar is the same.

If V is the voltage difference between two generic consecutive electrical contacts, then the corresponding current is equal to (1/R)×V (or more simply, V/R).

If $I_{tot}$ is the total current and N cathodes plus N+1 anodes per cell are present, then for any given cell:

$I_{tot}=\Sigma I(\text{anode } Y)$ with Y ranging from 1 to N+1 or $I_{tot}=\Sigma I(\text{cathode } Y)$ with Y ranging from 1 to N.

For all cells: $I_{tot}=(1/R)\times\{\Sigma V[k_{X(Y-1)}, a_{XY}]+V(k_{XY}, a_{XY})\}$ with Y ranging from 1 to N+1, hence for each cell: $1/R=I_{tot}/\{\Sigma V[k_{X(Y-1)}, a_{XY}]+V(k_{XY}, a_{XY})\}$ with Y ranging from 1 to N+1.

The same evaluation of 1/R can be made starting from the cathode currents in a cell.

This operation is carried out for all the current-collecting bus-bars: in this way the value of R is determined taking advantage of the multiple voltage readings. Upon determining R, which depends on the physical structure of the inter-cell current-collecting bus-bars, it is possible to determine the value of currents flowing in the multiplicity of electrodes. In particular, for the individual anode and cathode of a generic cell X it holds:

$$I(\text{anode } Y)=(1/R)\times\{V[(k_{X(Y-1)},a_{XY})]+V(k_{XY},a_{XY})\}$$

$$I(\text{cathode } Y)=(1/R)\times\{V[k_{(X+1)Y},a_{(X+1)Y}]+V[k_{(X+1)Y},a_{(Y+1)(Y+1)}]\}$$

A person skilled in the art may use other models, such as for instance in the case where auxiliary bus-bars are present.

In this case, with reference to FIG. 6, if I (Banode Y) is the current supplied to the anodes through the auxiliary bus-bar on which the anodes abut on the other side and $b_X$ are the points of contact between the auxiliary bus-bar and the anodes, it holds:

$$I(\text{Banode } Y)=I[b_{X(Y+1)},b_{XY}]-I[b_{XY},b_{X(Y-1)}]$$

Hence, by denoting with Rb the resistance of the portion of auxiliary bus-bar between two consecutive electrical contacts the following relationship is obtained:

$$I(\text{Banode } Y)=(1/R_b)\times\{V[b_{X(Y+1)},b_{XY}]-V[b_{XY},b_{X(Y-1)}]\},$$

and the total current fed to each anode will be:

$$I(\text{total current anode } Y)=I((\text{anode } Y)+I(\text{Banode } Y).$$

It should be noted that in the ideal case of perfect apportionment of the current to all anodes and cathodes, the current in the auxiliary bars is zero: this situation is perhaps observed in new plants when the various contacts have minimum and similar values. With the progress of operation, contacts worsen as a result of mechanical stress due to the extraction and re-positioning of the cathodes and to corrosion phenomena caused by acid mists and thus the function of auxiliary bus-bars where current starts to flow comes into play: the intensity of such current represents the degree of deterioration of the contacts.

The difference between I (total current of a generic anode Y) and the current expected for each anode in the ideal case of a perfectly uniform distribution allows to check the actual situation of current distribution and to intervene with operations of maintenance or replacement of plant components whenever such difference exceeds a predetermined value.

The previous description shall not be intended as limiting the invention, which may be used according to different embodiments without departing from the scopes thereof, and whose extent is solely defined by the appended claims.

Throughout the description and claims of the present application, the term "comprise" and variations thereof such as "comprising" and "comprises" are not intended to exclude the presence of other elements, components or additional process steps.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention before the priority date of each claim of this application.

The invention claimed is:

1. Device for continuously monitoring current distribution in cathodes and anodes of an electrolyser consisting of at least two adjacent electrolysis cells, each containing a multiplicity of said cathodes and anodes, said device comprising at least one inter-cell current collecting bus-bar and at least one base element, said inter-cell current collecting bus-bar consisting of an elongated main body of homogeneous electrical conductivity, said body comprising housings for supporting said cathodes and/or anodes and establishing an electrical contact therewith, said housings being evenly spaced apart, said inter-cell current collecting bus-bar abutting on said at least one base element made of insulating material equipped with integrated probes for detecting an electrical voltage and for establishing electrical contacts in correspondence of said housings of said inter-cell current collecting bus-bar, wherein said probes for detecting an electrical voltage and establishing electrical contacts are equipped with a retractable tip in correspondence of said electrical contacts.

2. Device for continuously monitoring current distribution in cathodes and anodes of an electrolyser consisting of at least two adjacent electrolysis cells, each containing a multiplicity of said cathodes and anodes, said device comprising an auxiliary cathode bus-bar, an auxiliary anode bus-bar, at least one inter-cell current collecting bus-bar arranged therebetween and at least one base element, said auxiliary bus-bars and said inter-cell bus-bar consisting of elongated bodies of homogeneous electrical conductivity, said inter-cell current collecting bus-bar consisting of an elongated main body of homogeneous electrical conductivity comprising housings for supporting said cathodes and/or anodes and establishing an electrical contact therewith, said auxiliary and said inter-cell bus-bars abutting on said at least one base element made of insulating material, said at least one base element containing integrated probes for detecting an electrical voltage and for establishing electrical contacts in correspondence of said housings of said inter-cell current collecting bus-bar and for detecting an electrical voltage and establishing electrical contacts evenly spaced on either of said auxiliary bus-bars, wherein said probes for detecting an electrical voltage and establishing electrical contacts are equipped with a retractable tip in correspondence of said electrical contacts.

3. Device for continuously monitoring current distribution according to claim 1, wherein said insulating material of said at least one base element is made of fibre-reinforced plastic (FRP).

4. Device according to claim 1 wherein said probes for detecting an electrical voltage and establishing electrical contacts are cables or wires.

5. Device according to claim 1 wherein said at least one base element comprises either rubber seals or springs lined with plastic fabric in correspondence of retractable tips.

6. Electrolyser comprising a multiplicity of cells for metal electrodeposition, said cells being mutually connected in electrical series by means of a device according to claim 1.

7. Electrolyser according to claim 6, wherein said multiplicity of cells is connected in electrical series:

at one end with a terminal cell whose anodes are connected to the positive pole of a direct power supply through a current collecting bus-bar equipped with housings for anodic electrical contacts;

and at the other end with a terminal cell whose cathodes are connected to the negative pole of said direct power supply through a current collecting bus-bar equipped with housings for cathodic electrical contacts;

said current collecting bus-bars abutting on at least one base element made of insulating material containing integrated probes for detecting an electrical voltage and establishing electrical contacts.

8. System for continuously monitoring current distribution in cathodes and anodes of an electrolyser having a multiplicity of cells for metal electrodeposition each equipped with a multiplicity of said cathodes and anodes, the system comprising:

a device according to claim 1;

analogue or digital computational means for obtaining current intensity values in each individual cathode and each anode starting from the electrical potential values detected by said probes;

an alert device;

a processor suitable for comparing the current intensity measurement provided by said computational means to a set of predefined critical values for each cathode and each anode;

means for actuating said alert device whenever said current intensity results not compliant to said corresponding predefined critical value for any cathode or anode.

9. Method for retrofitting an electrolyser consisting of at least two adjacent electrolysis cells and equipped with at least one inter-cell current collecting bus-bar, said inter-cell current collecting bus-bar consisting of an elongated main body of homogeneous electrical conductivity equipped with evenly spaced apart housings for supporting cathodes and/or anodes and establishing an electrical contact therewith, said inter-cell current collecting bus-bar abutting on at least one original base element made of insulating material comprising the steps of:

lifting said at least one inter-cell current collecting bus-bar from said original base element;

substituting said original base element with at least one replacement base element made of insulating material, said replacement base element containing integrated probes for detecting an electrical voltage and for establishing electrical contacts in correspondence of said housings of said at least one current collecting bus-bar, wherein said probes for detecting an electrical voltage and establishing electrical contacts are equipped with a retractable tip in correspondence of said electrical contacts; and putting said inter-cell current collecting bus-bar in abutment with said replacement base element.

10. Method according to claim 9 wherein said electrolyser consisting of at least two adjacent electrolysis cells is equipped with one inter-cell current collecting bus-bar, one auxiliary cathode bus-bar and one auxiliary anode bus-bar.

11. Method according to claim 9 or 10 wherein said step of putting said inter-cell current collecting bus-bar in abutment with said replacement base element is carried out by aid of guides.

12. Device for continuously monitoring current distribution according to claim 2, wherein said insulating material of said at least one base element is made of fibre-reinforced plastic (FRP).

13. Device according to claim 2 wherein said probes for detecting an electrical voltage and establishing electrical contacts are cables or wires.

14. Device according to claim 2 wherein said at least one base element comprises either rubber seals or springs lined with plastic fabric in correspondence of retractable tips.

15. Electrolyser comprising a multiplicity of cells for metal electrodeposition, said cells being mutually connected in electrical series by means of a device according to claim 2.

16. System for continuously monitoring current distribution in cathodes and anodes of an electrolyser having a multiplicity of cells for metal electrodeposition each equipped with a multiplicity of said cathodes and anodes, the system comprising:

a device according to claim 2;

analogue or digital computational means for obtaining current intensity values in each individual cathode and each anode starting from the electrical potential values detected by said probes;

an alert device;

a processor suitable for comparing the current intensity measurement provided by said computational means to a set of predefined critical values for each cathode and each anode;

means for actuating said alert device whenever said current intensity results not compliant to said corresponding predefined critical value for any cathode or anode.

17. Method according to claim 10 wherein said step of putting said inter-cell current collecting bus-bar in abutment with said replacement base element is carried out by aid of guides.

* * * * *